US005100736A

United States Patent [19]

London et al.

[11] Patent Number: 5,100,736

[45] Date of Patent: Mar. 31, 1992

[54] POLYMER-REINFORCED METAL MATRIX COMPOSITE

[75] Inventors: Gilbert J. London, Wrightstown; William E. Frazier, Philadelphia, both of Pa.; John G. Williams, Dollar Bay, Mich.

[73] Assignee: The United States of America as represented by the Secretary of the Navy, Washington, D.C.

[21] Appl. No.: 660,364

[22] Filed: Feb. 19, 1991

[51] Int. Cl.[5] ..... B22F 7/00; C22C 29/00

[52] U.S. Cl. ..... 428/549; 428/551; 428/373; 419/10; 419/38; 419/47; 419/48; 75/230; 75/249

[58] Field of Search ..... 419/4, 10, 38, 47, 48; 428/361, 373, 402, 549, 551; 75/230, 249

[56] References Cited

U.S. PATENT DOCUMENTS

| | | | |
|---|---|---|---|
| 3,864,124 | 2/1975 | Breton et al. | 75/212 |
| 4,194,040 | 3/1980 | Breton et al. | 75/211 X |
| 4,961,990 | 10/1990 | Yamada et al. | 428/240 |

OTHER PUBLICATIONS

Metal Filled Plastics, Delmonte, Reinhold Publishing Co., 1961, pp. 49-52.

Handbook of Powder Metallurgy, H. Hausner, Chemical Publishing Co., 1973.

*Primary Examiner*—Brooks H. Hunt

*Assistant Examiner*—Daniel J. Jenkins

*Attorney, Agent, or Firm*—James V. Tura; James B. Bechtel; Susan E. Verona

[57] ABSTRACT

A polymer-reinforced metal matrix composite is disclosed which is formed by blending metal particles and polymer particles to form a homogeneous powder blend, and consolidating the powder blend to form a unitary mass. The unitary mass is then plastically deformed such as by extrusion in the presence of heat so as to cause an elongation thereof, whereby the metal particles form a matrix and the polymer particles form elongated filaments uniformly dispersed throughout the matrix and aligned in the direction of elongation of the unitary mass. An aluminum matrix reinforced with polyether-etherketone is shown to have enhanced specific strength and modulus over those of the aluminum alone.

14 Claims, No Drawings

POLYMER-REINFORCED METAL MATRIX COMPOSITE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to metal matrix composite (MMC) materials, and more particularly to polymer-reinforced metal matrix composites wherein polymer filaments are formed during processing of the MMC.

Metal matrix composite materials, wherein a metal is reinforced with a non-metal, offer various advantages over the metals alone. In particular, MMC's incorporating a less-dense reinforcing non-metal have been developed for use in low-density applications such as for aircraft components. Such MMC's provide other improved properties as well. For instance, the toughness, specific strength, and specific modulus of metals such as aluminum and titanium can be enhanced by reinforcing them with boron, carbon, or silicon carbide filaments. These filaments are prepared separately and then incorporated into the matrix by processes such as vacuum hot-pressing, hot-isostatic pressing, and melt infiltration. Such processes, while yielding a product with many desirable mechanical properties, are often labor intensive and relatively expensive compared to processes for producing the unreinforced metal matrix material. Another commonly-used form of MMC is the laminated or sandwich structure, which is formed by bonding metal sheet or foil to prefabricated fibers. This process tends to limit the form of the product to sheet or plate, and consequently limits subsequent processing to processes which can be performed on sheet or plate and which will not break the fibers.

The low density of polymers makes them an attractive candidate for use as reinforcement in MMC's. Some work has been done in the area of plastically deforming polymers, alone and within a flexible polymer matrix, and the properties of polymers such as polyethylene, polypropylene, poly(arlyletherketone), and polyetheretherketone (PEEK) have been substantially improved by extruding and drawing. Nearly a three-fold increase in modulus for PEEK has been observed after drawing it through a die to a reduction of 3:1 at 310° C. (A. Richardson et al., *Polymer Engineering and Science*, 25(6)(1985), 355–361). It has also been found that under certain conditions thermotropic liquid crystal polymers form high-modulus and high-strength filaments when deformed in a flexible polymer matrix at high strain rates. (A. I. Isayev et al., *Polymer Composites*, 8(3)(1987), 158–175.) The similarities in flow characteristics between the polymer matrix and the polymer reinforcement material make them compatible for co-extrusion. In other words, their strength and their elastic, viscoelastic, and plastic behavior as a function of temperature and strain rate are similar, causing them to deform similarly during extrusion. However, substantial differences exist between the way polymers and metals flow and deform, making co-processing appear unattractive and difficult.

SUMMARY OF THE INVENTION

Accordingly, it is the general object of the present invention to provide a method of producing a polymer-reinforced metal matrix composite. More particularly, it is an object to provide a simple and relatively inexpensive method of producing a polymer-reinforced metal matrix composite. Another object is to provide a method of producing a polymer-reinforced metal matrix composite wherein polymer filaments or films are formed during processing of the MMC. Yet another object is to provide a polymer-reinforced metal matrix composite which can be subsequently processed by a variety of methods. Still another object of the invention is to provide an aluminum matrix composite material with reduced density, increased specific strength, enhanced damage tolerance, and increased mechanical damping capability compared to the corresponding properties of the aluminum material alone.

Briefly, these and other objects of the present invention are accomplished by a polymer-reinforced metal matrix composite formed by the steps of blending metal particles and polymer particles to form a homogeneous powder blend, and consolidating the powder blend to form a unitary mass. The unitary mass is then plastically deformed in the presence of heat so as to cause an elongation thereof, whereby the metal particles form a matrix and the polymer particles form elongated filaments uniformly dispersed throughout the matrix and aligned in the direction of elongation of the unitary mass.

Other objects, advantages, and novel features of the invention will become apparent from the following detailed description of the invention.

DESCRIPTION OF THE PREFERRED EMBODIMENT

The present invention provides a polymer-reinforced metal matrix composite comprising a uniform distribution of polymer filaments throughout a metal matrix. The composite is formed from a consolidated powder blend by extrusion or other hot-working process accompanied by large plastic deformation or strain and concomitant elongation of the consolidated powder blend. The polymer filaments, which are formed from particles during the extrusion or other deformation process, are aligned in the direction of elongation. The composite comprises up to 30 volume percent polymer, the preferred amount varying with the choice of polymer and the desired properties. The filament dimensions vary with the amount of elongation or reduction during hot-working. Compared to the metal matrix material alone, the composite has reduced density, increased specific strength, enhanced damage tolerance, and improved mechanical damping capability. The invention is particularly useful in applications where lower density and higher strength are desirable characteristics, such as for aircraft.

The matrix material may be any metal, the needs of the application dictating the selection. The choice of metal is governed in large part by the same criteria as would be used for selecting the metal for use by itself, bearing in mind that the composite will have lower density and higher specific strength than does the metal by itself. Light-weight metals such as aluminum, titanium, and magnesium, and alloys of these metals, are particularly desirable choices. The choice of metal affects other aspects of the inventive process, such as the choice of polymer to be used and the hot-working or extrusion temperature, which will be within the generally recognized processing temperature range for the chosen metal.

The metal matrix material of choice is then reduced to powder. Any powder metallurgical technique known to those skilled in the art may be used, such as rapid solidification, which is a convenient means of producing a powder and has the added advantage of producing particles which are homogeneous in composition. Other standard powder metallurgical procedures may be performed on the powder which are normally recommended for the metal powder of choice, such as vacuum degassing it to remove moisture, or pulverizing it to reduce particle size. The metal powder's particle size should be as fine as possible within the generally recommended size range for that particular powdered metal. Finer particle size promotes better blending of powders. For example, −325 mesh powder (<45 microns, ASTM std B214-76) has been found to work well for aluminum.

The polymer must be a thermoplastic, meaning that it is deformable when heated, in order for the polymer to achieve the necessary degree of molecular mobility to become filaments during processing. Thermoplastics can also undergo repeated extensive mechanical deformation without breaking the primary chemical bonds which give polymers their desirable properties. Several factors enter into the selection of thermoplastic powder for the invention, some of which are dependent upon the metal powder chosen. The thermoplastic must be deformable at the recommended hot-working temperature for the metal powder of choice. For instance, semi-crystalline thermoplastics are deformable above their glass-transition temperatures (Tg). Additionally, the thermoplastic's viscosity must be between $10^2$ and $10^7$ poise at the hot-working temperature. If the thermoplastic is too runny, which can occur if the hot-working temperature is too high above the thermoplastic's melting temperature (Tm), it may leak out from the matrix during processing. If it is too viscous, as can happen when processing is done significantly below the Tm, the primary chemical bonds may break during hot-working. For most thermoplastics, their viscosities will be within the necessary range when they are near their Tm, although other factors such as processing strain rate can influence viscosity as well. Thermal agitation can also break primary chemical bonds and for this reason the thermoplastic's decomposition temperature should be above the hot-working temperature. The thermoplastic should preferably be liquid crystal so that if it is processed above the Tm it will retain its crystalline structure, and it should also preferably have a tendency to crystallize at room temperature so that it retains its molecular orientation after deformation. Additionally, the thermoplastic should preferably have good wettability with the metal matrix material for better bonding thereto. The thermal expansivities of the chosen metal and the chosen thermoplastic should not be vastly different, to reduce problems of residual stresses which can cause cracking in the hot-worked product. The powder particle size should be comparable to or smaller than that of the metal matrix particle, to enhance homogeneous blending of the two and to permit the thermoplastic to infiltrate the interstices of the metal powder. The powder should be dried prior to mixing to drive off moisture. Examples of polymers suitable for combination with aluminum are such high-temperature semi-crystalline thermoplastics as PEEK (Tg=143° C., Tm=334° C., and viscosity at aluminum's hot-working temperature is between $10^3$ and $10^4$ poise), and a liquid crystal co-polyester, commercially available as Xydar (Trademark) (Tm=421° C. and viscosity at aluminum's hot-working temperature is between $10^4$ and $10^5$.)

The metal and polymer powders are then combined in the desired proportion and mixed to form a powder blend. Up to 30 volume percent polymer has been found to be an acceptable composition. More than 30 volume percent polymer interferes with the ability of the powders to consolidate. The optimum polymer content is around 5%, but will depend upon what properties are to be maximized in the composite. For example, if weight is the most important factor, higher amounts of polymer should be included. The choice of polymer will affect the amount of polymer in the composite as well. For example, if there is a large difference in the thermal expansivity between the chosen polymer and the metal, less polymer should be incorporated into the composite.

The combined powders are then mixed until they are uniformly blended. This may be achieved by tumbling the powders in a rotating cylinder or V-cone blender for one hour. The blend should be vacuum-degassed to drive off moisture and, in the case of a matrix of aluminum, magnesium or titanium, to reduce amorphous oxides to crystalline oxides.

The powder blend is then prepared for further processing by either canning it or compacting it into a unitary mass for ease of handling. If the powder is canned, the vacuum-degassing step may be performed by evacuating the can, as known by those skilled in the art. Alternatively, the blend may be vacuum hot-pressed, during which the degassing of the powder blend occurs. The compacting parameters such as temperature and pressure are dictated by the metal matrix material with the proviso that the temperature not exceed the polymer's decomposition temperature. Some melting or viscous flow during vacuum hot pressing may be desirable in order to fill the interstices of the metal powder. Of course, the powder blend could be cold-compacted in combination with either canning plus evacuation or vacuum hot-pressing.

The unitary mass is then hot-worked, or plastically deformed in the presence of heat, at a reduction ratio high enough to achieve a molecular alignment of the polymer. When the unitary mass is thus deformed, the metal particles bond to form a continuous matrix while the polymer particles flow into interstices of the metal as they elongate, and simultaneously realign their molecular structure. Extrusion is a preferred means of plastic deformation and causes the polymer particles to align parallel to the extrusion direction. An extrusion ratio of at least 8-to-1 is required, but the higher the reduction ratio the stronger and stiffer the polymer becomes. A reduction ratio of 32-to-1 has been found to be effective for aluminum, although ratios in the thousands are possible. Extrusion is not limited to a single step process, since extruded material may be cut, assembled, and re-extruded several times, thereby achieving an extrusion reduction ratio of several thousands. Extrusion ratio also affects the dimension of the filaments. PEEK particles form filaments that are typically 9 to 30 microns long and 4 to 8 microns thick when extruded in an aluminum matrix at a 10-to-1 reduction ratio. Extrusion ratios of 1000-to-1 produce PEEK filaments 900 to 3000 microns in length and less than 0.5 microns in thickness.

Any extrusion process may be used, including direct, indirect, and hydrostatic processes. The extrusion die may be either conical or right-angle, the right-angle type providing greater shear forces. Any die shape may be used; the die shape determines flow behavior, which in turn influences the cross-sectional shape of the filaments. For instance, a die with a circular cross-section will tend to yield filaments with a circular cross-section, although the viscosity of the polymer at the processing temperature also influences filament shape, in that low viscosity encourages the formation of films regardless of die shape. Of course, in the case of a die with a complex shape, the filaments will tend to be the shape determined by the localized flow behavior. The true strain rate during extrusion should be controlled to maintain the polymer within the necessary viscosity range, viscosity decreasing with increasing strain rate.

The hot-working temperature for the composite will be within the recommended hot-working temperature range for the matrix material. The polymer is selected to be compatible with that hot-working temperature, as discussed above, so that the hot-working will take place at a temperature at which the polymer is deformable (for example above the Tg of a semi-crystalline polymer) but which is no greater than the polymer's decomposition temperature. It may be advantageous to slightly melt the polymer to facilitate infiltration of the polymer particles into the matrix. Hot-working above the polymer's Tm also tends to cause the polymer to flatten into a film between metal particles due to the lower viscosity at higher temperatures. The hot-worked or extruded composite may be further processed in the same manner as other hot-worked or extruded products are processed, such as by machining or turning on a lathe.

The invention may best be illustrated by the following examples.

EXAMPLE

Three each of four different composites were made in accordance with the invention. Table I is a description of the four different composites and their designations. One of them was a commercially pure aluminum plus the thermoplastic, PEEK. Two of them were a commercially pure aluminum plus the thermotropic liquid crystal co-polyester (LCPE), XYDAR. The fourth was a high-strength, age-hardenable 7091 aluminum plus PEEK. In addition, a pure aluminum powder alloy was prepared as a control specimen.

TABLE I

| Designation | Constituents |
|---|---|
| CPAL | Commercially pure aluminum (control specimen) |
| AP05 | aluminum + 5 volume percent PEEK |
| AZ05 | aluminum + 5 volume percent LCPE (XYDAR) |
| AZ07 | aluminum + 7.5 volume percent LCPE (XYDAR) |
| SP10 | high-strength, age-hardenable 7091 aluminum + 10 volume percent PEEK |

The specimens were prepared by blending the powders in the proportions indicated in a rotating cylinder blender. Specimens CPAL and APO5 were vacuum-degassed at 232° C., hot pressed at 343° C. (which is above the 334° C. $T_m$ for PEEK) and extruded at a 32:1 area reduction at 315° C. (<PEEK's $T_m$). Samples AZO5 and AZO7 were vacuum-degassed at 232° C. for two hours and then vacuum hot-pressed into a right cylindrical compact at 315° C. (which is less than XYDAR's Tm) inside the extrusion chamber, without a can. The compacts were then hot-extruded on a 200-ton Advanced Metalworking System at 399° C. (<XYDAR's Tm) and an extrusion ratio of 32:1. Sample SP10 was prepared by blending −200 mesh, gas atomized, 7091 aluminum powder with PEEK for one hour in a V-cone blender. The powder blend was then vacuum sealed inside a fully annealed 7075 aluminum can and degassed and hot-extruded at 400° C. (>PEEK's Tm) at an extrusion ratio of 12:1. The rate of extrusion for all samples was between 0.16 mm/sec and 0.68 mm/sec and the true strain rate was between 0.03 $s^{-1}$ and 0.16 $s^{-1}$.

The finished composites were completely consolidated and exhibited very little porosity. The polymer particles thinned and elongated in the extrusion direction and filled the interstices of the aluminum powder. The quantitative microstructural analysis of the size, distribution, and volume fraction of polymeric second phase for the PEEK-reinforced composites in the plane parallel to the direction of elongation is presented in Table II. The average breadth of the PEEK ranges from 4.1 to 5.7 microns. The average length ranges from 9.4 to 16.6 microns. The average length-to-breadth ratio ranges from 2.3 to 2.9. The average cross-sectional area of the PEEK phase exhibits the widest range of values, i.e., 41 to 108 square microns.

TABLE II

Quantitative Microstructural Analysis of the Distribution of PEEK Along the Extrusion Axis.

| Alloy | Area* | Breadth** | Length** | Vol. % | Length/Breadth |
|---|---|---|---|---|---|
| AP05 | 41 | 4.1 | 9.4 | 3.9 | 2.3 |
| Std. Dev. | 86 | 7.2 | 21.7 | 1.3 | |
| SP10 | 108 | 5.7 | 16.6 | 12.9 | 2.9 |
| Std. Dev. | 369 | 7.7 | 30.8 | 3.0 | |

*Units of square microns
**Units of microns

Tensile tests were performed on the extruded alloys in accordance with ASTM E8-81 on an instron test machine at a strain rate of $10^{-3}s^{-1}$, in order to evaluate their ambient temperature response. The tensile specimens were 100 mm long and 6 mm in diameter. The reduced section was 16 mm long and 4 mm in diameter. The tensile properties of the extruded materials are presented in Table III.

TABLE III

Tensile Properties of Extruded Samples

| Alloy | YS, MPa | UTS, MPa | % Elong. | % RA |
|---|---|---|---|---|
| CPAL | 95.3 | 134.4 | 25.5 | 99 |
| AP05 | 112.7 | 152.7 | 5.75 | — |
| AZ05 | 106.9 | 124.6 | 14.4 | 38.4 |
| AZ07 | 109.2 | 125.1 | 8.9 | 17.8 |
| SP10 | 207 | 224 | 2.0 | — |

Table IV provides the baseline material properties of the various constituents of the sample composites.

TABLE IV

BASELINE MATERIAL PROPERTIES OF COMPOSITE CONSTITUENT

| MATERIAL | YS, MPa | DENSITY, g/cc |
|---|---|---|
| extruded CPAL | 95.3 | 2.7 |
| injection molded PEEK | <100 | 1.3 |
| injection molded XYDAR | <80 | 1.85 |

If the properties of a consolidated two-phase material (aluminum and a polymer) are measured, the "Rule of Mixtures" (ROM) applies unless one or both of the phases is altered during processing. Table V provides a comparison of the measured yield strengths and those calculated using the ROM. The measured yield strengths are greater than those calculated using the ROM. The 13% to 18% increase in strength observed is directly attributable to the molecular alignment of the polymeric phase during extrusion.

TABLE V

MEASURED YIELD STRENGTH COMPARED WITH VALUES CALCULATED USING THE RULE OF MIXTURES

| MATERIAL | YS, MPa | ROM YS, MPa | % DIFFERENCE+ |
|---|---|---|---|
| AP05 | 112.7 | 95.5 | 18.0 |
| AZ05 | 106.9 | 94.5 | 13.1 |
| AZ07 | 109.2 | 93.7 | 16.5 |

+% DIF = 100 × (ACTUAL YS − ROM YS)/ROM YS

Specific properties, properties divided by density, (e.g., alloy strength/alloy density) are very important in the design of aircraft, the greater the specific property the better. Table VI indicates that the composites have substantially enhanced specific properties compared to the control specimen.

TABLE VI

SPECIFIC YIELD STRENGTH OF THE POLYMETS AND THE CONTROL SPECIMEN, VIZ., CPAL

| MATERIAL | SPECIFIC YS. ($kPam^3/Kg$)* | % DIFFERENCE+ |
|---|---|---|
| CPAL | 35.3 | 0.0 |
| AP05 | 42.8 | 21.2 |
| AZ05 | 40.2 | 13.9 |
| AZ07 | 41.4 | 17.3 |

*SPECIFIC YS = ALLOY YIELD STRENGTH/ALLOY DENSITY
+% DIF = 100 × (SPECIFIC YIELD STRENGTH OF THE POLYMET − THE SPECIFIC YIELD STRENGTH OF THE CONTROL SPECIMEN)/THE SPECIFIC YIELD STRENGTH OF THE CONTROL SPECIMEN

Some of the many advantages and novel features of the present invention should now be readily apparent. For instance, a simple and relatively inexpensive method of producing a polymer-reinforced metal matrix composite has been provided, wherein polymer filaments are formed during processing of the MMC. The process lends itself to the direct production of complex shapes, if desired, in a final product form, or the composite can be subsequently processed by a variety of methods. A PEEK-reinforced aluminum composite has been provided which has reduced density and increased specific strength. Additionally, the aluminum's damage tolerance is enhanced by the polymer because of the latter's greater ductility, and the aluminum's mechanical damping capability is enhanced because the polymer does not transmit dynamic elastic waves as efficiently as the aluminum does, because of its lower modulus.

Other embodiments and modifications of the present invention may readily come to those of ordinary skill in the art having the benefit of the teachings of the foregoing description. For example, other hot-working processes than the one specifically described may be employed, such as rolling, forging, swaging, and wire-drawing. The invention may be practiced using other metal matrices as well, such as steel. Therefore, it is to be understood that the present invention is not to be limited to the teachings presented and that such further embodiments and modifications are intended to be included in the scope of the appended claims.

We claim:

1. A method of making a polymer-reinforced metal matrix composite, comprising the steps of:

blending metal particles and thermoplastic polymer particles to form a homogeneous powder blend;

consolidating the powder blend to form a unitary mass; and plastically deforming the unitary mass at an elevated temperature which is below the decomposition temperature of the thermoplastic polymer and at a reduction ratio greater than 8 to 1 so as to cause an elongation of the unitary mass, whereby the metal particles form a matrix and the thermoplastic polymer particles form elongated filaments uniformly dispersed throughout the metal matrix and aligned in the direction of elongation of the unitary mass.

2. The method of claim 1, wherein the step of plastically deforming the unitary mass is accomplished by extrusion.

3. The method of claim 1, wherein the composite comprises up to 30 volume percent thermoplastic.

4. The method of claim 3, wherein the composite comprises from 5 to 10 volume percent thermoplastic.

5. The method of claim 1, wherein the metal is aluminum.

6. The method of claim 5, wherein the thermoplastic polymer is polyether-etherketone.

7. A method of making a thermoplastic-reinforced aluminum matrix composite, comprising the steps of:

blending aluminum particles and thermoplastic polymer particles to form a homogeneous powder blend comprising 5 to 10 volume percent thermoplastic polymer;

consolidating the powder blend to form a unitary mass; and extruding the unitary mass at an elevated temperature which is below the decomposition temperature of the thermoplastic polymer and at a reduction ratio of at least 32 to 1, whereby the aluminum particles form a matrix and the thermoplastic polymer particles form filaments uniformly dispersed throughout the aluminum matrix and aligned in the direction of extrusion.

8. The method of claim 7, wherein the thermoplastic polymer is polyether-etherketone.

9. The method of claim 8, wherein the unitary mass is extruded at a temperature above the polyether-etherketone's glass transition temperature.

10. The method of claim 9, wherein the unitary mass is extruded at a temperature near the polyether-etherketone's melting temperature.

11. The method of claim 7, wherein said consolidating step includes compacting and vacuum-degassing the powder blend.

12. A metal matrix composite, comprising thermoplastic polymer filaments uniformly dispersed throughout and bonded to a metal matrix material, said composite being formed by extrusion at an elevated temperature which is below the decomposition temperature of the thermoplastic polymer and said thermoplastic polymer filaments being formed during extrusion and aligned in the direction of extrusion.

13. A polymer-reinforced metal matrix composite formed by the method of claim 1.

14. A polymer-reinforced metal matrix composite formed by the method of claim 7.

* * * * *